US009558697B2

(12) United States Patent
Kitani

(10) Patent No.: US 9,558,697 B2
(45) Date of Patent: Jan. 31, 2017

(54) DISPLAY DEVICE DRIVING SUB-PIXELS OF A PLURALITY OF COLORS

(71) Applicant: Japan Display Inc., Minato-ku (JP)

(72) Inventor: Masakatsu Kitani, Minato-ku (JP)

(73) Assignee: Japan Display Inc., Minato-ku (JP)

( * ) Notice: Subject to any disclaimer, the term of this patent is extended or adjusted under 35 U.S.C. 154(b) by 0 days.

(21) Appl. No.: 14/540,540

(22) Filed: Nov. 13, 2014

(65) Prior Publication Data

US 2015/0138055 A1 May 21, 2015

(30) Foreign Application Priority Data

Nov. 21, 2013 (JP) ..... 2013-240618

(51) Int. Cl.
*G09G 3/36* (2006.01)

(52) U.S. Cl.
CPC ..... *G09G 3/3607* (2013.01); *G09G 3/3648* (2013.01); *G09G 2300/0443* (2013.01); *G09G 2300/0452* (2013.01); *G09G 2320/0209* (2013.01)

(58) Field of Classification Search
CPC ..... G09G 3/3607; G09G 2320/0209
USPC ..... 345/88
See application file for complete search history.

(56) References Cited

U.S. PATENT DOCUMENTS

2005/0275610 A1* 12/2005 Roh ..... G09G 3/3614 345/88
2006/0262251 A1* 11/2006 Kim ..... G02F 1/133514 349/106
2009/0322802 A1* 12/2009 Noguchi ..... G09G 3/2003 345/694
2011/0181634 A1 7/2011 Higashi et al.
2012/0086743 A1* 4/2012 Shiomi ..... G02F 1/136213 345/694
2012/0206512 A1* 8/2012 Kim ..... G02F 1/133514 345/691
2014/0204072 A1* 7/2014 Yamaguchi ..... G09G 3/3614 345/212

FOREIGN PATENT DOCUMENTS

JP 2011-154321 8/2011
JP 2013-113880 6/2013

* cited by examiner

*Primary Examiner* — Chanh Nguyen
*Assistant Examiner* — Daniel Duong
(74) *Attorney, Agent, or Firm* — Oblon, McClelland, Maier & Neustadt, L.L.P.

(57) ABSTRACT

According to one embodiment, a display element includes a plurality of scanning lines and a plurality of signal lines. Into the plurality of signal lines, signals of different polarities are alternately input, respectively. In the respective regions surrounded by the scanning lines and the signal lines, a first pixel and a second pixel are arrayed. Along the scanning line, two each of the first pixels and the second pixels are provided, and the two first pixels or the two second pixels are arrayed so as to be juxtaposed to each other. Along the signal line, the first pixel and the second pixel are arrayed alternately.

4 Claims, 3 Drawing Sheets

DISPLAY DEVICE DRIVING SUB-PIXELS OF A PLURALITY OF COLORS

INCORPORATION BY REFERENCE

The present invention claims priority under 35 U.S.C. §119 to Japanese Patent Application No. 2013-240618 filed on Nov. 21, 2013. The content of the application is incorporated herein by reference in its entirety.

FIELD

An embodiment of the present invention relates to a display element that drives sub-pixels of a plurality of colors by a plurality of switching elements, respectively.

BACKGROUND

Conventionally, for a display element, for example, a color liquid crystal display element, etc., a technique with which one pixel is constituted by adding a white sub-pixel to sub-pixels of three primary colors of red, green, and blue is used. Thus, by adding a white sub-pixel to the sub-pixels of three primary colors, an improvement in luminance and a reduction in power consumption of the backlight can be realized.

In the case where a white sub-pixel is added into the size of the sub-pixels of three primary colors, the aperture ratio of each sub-pixel decreases, and a luminance increasing effect according to the addition of the white sub-pixel cannot be sufficiently obtained.

Therefore, in some constitutions, a first pixel consisting of the sub-pixels of three primary colors and a second pixel constituted by adding a white sub-pixel to sub-pixels of two colors of the three primary colors are used, and these first pixel and second pixel are arrayed alternately in the horizontal direction and the vertical direction, and accordingly, while the aperture ratio of each sub-pixel is secured, a luminance increasing effect according to the addition of the white sub-pixel is obtained.

However, with this pixel array, crosstalk easily occurs in a specific display and the display quality lowers, so that it has been demanded to improve this.

DETAILED DESCRIPTION

A display element according to the present embodiment includes a plurality of scanning lines disposed along a first direction, a plurality of signal lines that are disposed along a second direction orthogonal to the first direction and into which signals of different polarities are alternately input, respectively, a plurality of first pixels each of which includes sub-pixels of three primary colors that are respectively disposed in the respective regions surrounded by the scanning lines and the signal lines so as to be juxtaposed to each other in the first direction, a plurality of second pixels each of which includes sub-pixels of two colors of the three primary colors and a sub-pixel of a color other than the three primary colors that are respectively disposed in the respective regions surrounded by the scanning lines and the signal lines so as to be juxtaposed to each other in the first direction, and a plurality of switching elements that are respectively connected to the scanning lines and the signal lines, and are switched by signals from the scanning lines and write signals corresponding to the signals from the signal lines on the sub-pixels when the switching elements are in an on state, and along the first direction, two each of the first pixels and the second pixels are provided, and at least either two of the first pixels and the second pixels are arrayed so as to be juxtaposed to each other, and along the second direction, the first pixel and the second pixel are arrayed alternately.

Hereinafter, an embodiment is described with reference to FIG. 1 to FIG. 7.

Figure 1:
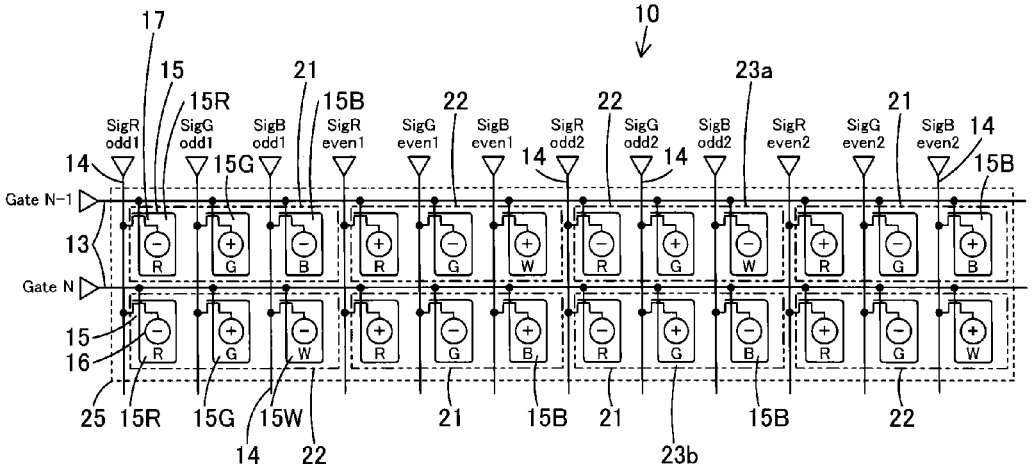
FIG. 1 is a front view schematically showing a part of a display element showing an embodiment.

As shown in FIG. 1, a display element 10 is, for example, an active matrix type liquid crystal panel capable of performing color display.

This liquid crystal panel is constituted by disposing an array substrate and a counter substrate so as to oppose each other, and between these substrates, interposing a liquid crystal layer as a light modulation layer and a spacer not illustrated that holds the distance between the substrates constantly, and bonding peripheral edge portions of these by an adhesive layer not illustrated. In a display region at the center portion of the liquid crystal panel, a plurality of pixels are disposed in a matrix along the vertical direction and the horizontal direction, respectively.

On the array substrate, a plurality of scanning lines (gate wires) 13 are disposed along the horizontal direction as the first direction so as to be spaced from each other, and a plurality of signal lines (source wires) 14 are disposed along the vertical direction as the second direction so as to be spaced from each other, and these scanning lines 13 and the signal lines 14 are arrayed in a lattice form while being electrically insulated from each other. At positions surrounded by the scanning lines 13 and the signal lines 14, pixel electrodes 16 respectively constituting sub-pixels 15 are disposed. The pixel electrodes 16 are made of a transparent conductive material, for example, ITO, etc.

At each of the intersections of these scanning lines 13 and signal lines 14, a thin film transistor (TFT) 17 as a switching element for driving the sub-pixel 15 is provided. The thin film transistor 17 includes a semiconductor layer constituting a channel region by polycrystalline silicon, etc., formed on an undercoat insulating film of the array substrate, a gate insulating film formed on this semiconductor layer, a gate electrode that is formed on the gate insulating film and electrically connected to the scanning line 13, a source electrode that is connected to one end side of the semiconductor layer and electrically connected to the signal line 14, and a drain electrode that is connected to the other end side of the semiconductor layer and electrically connected to the pixel electrode 16 constituting the sub-pixel 15, etc.

The pixels to be disposed in the display region include a plurality of first pixels 21 and a plurality of second pixels 22.

The first pixel 21 consists of the sub-pixels 15 of three primary colors of a red sub-pixel (R) 15R, a green sub-pixel (G) 15G, and a blue sub-pixel (B) 15B, and these are arrayed in order in the horizontal direction.

The second pixel 22 consists of the sub-pixels 15 of a red sub-pixel 15R, a green sub-pixel 15G, and a white sub-pixel (W) 15W, and these are arrayed in order in the horizontal direction.

The pixel array of one period that performs pixel driving includes four each of the first pixels 21 and the second pixels 22, so that the pixel array consists of eight pixels.

Along the horizontal direction, either two of the first pixels 21 and the second pixels 22 are arrayed so as to be juxtaposed to each other, and along the vertical direction, the first pixel 21 and the second pixel 22 are arrayed alternately.

Figure 2:
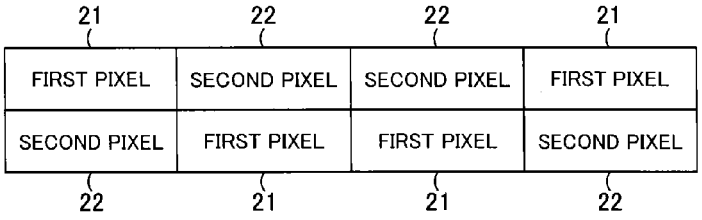
FIG. 2 is a block diagram showing a part of the display element.

In the present embodiment, as shown in FIG. 1 and FIG. 2, a first array group 23*a* including the first pixel 21, the second pixel 22, the second pixel 22, and the first pixel 21 that are arrayed in order along the horizontal direction, and a second array group 23*b* including the second pixel 22, the first pixel 21, the first pixel 21, and the second pixel 22 that are arrayed in order along the horizontal direction, are provided, and along the vertical direction, the first array group 23*a* and the second array group 23*b* are arrayed alternately.

For the pluralities of first pixels 21 and second pixels 22 of one period, a common electrode 25 is provided. The common electrode 25 is made of a transparent conductive material, for example, ITO, etc.

Figure 4:
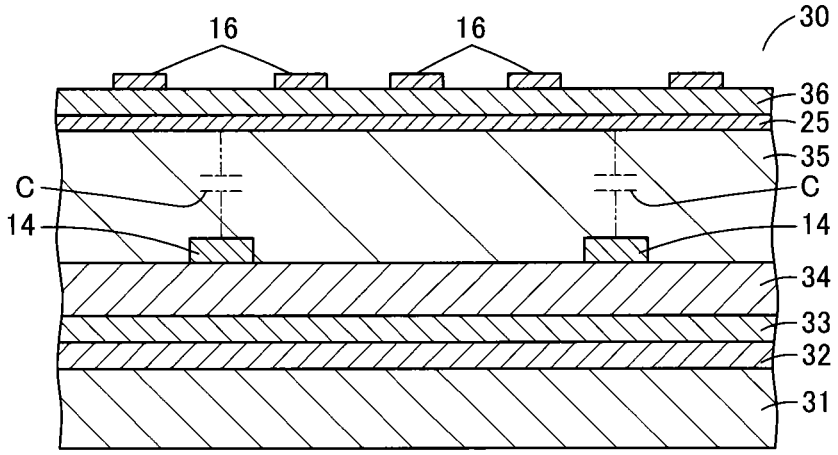
FIG. 4 is a sectional view showing the display element.

FIG. 4 is a sectional view showing the display element, and is a sectional view of an array substrate 30 that includes the pixel electrodes 16 and the common electrode 25, and uses an FFS (Fringe Field Switching) mode as a liquid crystal display mode that switches liquid crystal molecules by using a transverse electric field formed between the pixel electrodes 16 and the common electrode 25.

The array substrate 30 includes a glass substrate 31 which is, for example, an insulating substrate with translucency. On a principal surface on the liquid crystal layer side of the glass substrate 31, the semiconductor layers of the thin film transistors 17 are formed via an undercoat insulating film 32. On the semiconductor layers, the gate electrodes of the thin film transistors 17 are formed via a gate insulating film 33, and on the gate insulating film 33, the scanning lines 13 are formed. On the gate electrodes and the scanning lines 13, an interlayer insulating film 34 is formed, and on the interlayer insulating film 34, the signal lines 14 and the source electrodes and drain electrodes of the thin film transistors 17 are formed. On the interlayer insulating film 34, the signal lines 14, and the source electrodes and drain electrodes of the thin film transistors 17, an organic insulating film 35 is formed, and on the organic insulating film 35, the common electrode 25 is formed. On the organic insulating film 35 and the common electrode 25, an insulating film 36 is formed, and on the insulating film 36, the pixel electrodes 16 are formed.

On the other hand, in the counter substrate, a color filter layer being a coloring layer, counter electrodes, and an orientation film for orienting liquid crystal molecules of the liquid crystal layer, etc., are laminated in order on a glass substrate. The color filter layer includes filter portions respectively corresponding to red, green, blue, and white, and a light shielding portion that segments the filter portions and shields against unnecessary light, and the filter portions are respectively formed at the portions corresponding to the pixel electrodes 16 and constitute the respective sub-pixels 15. As the filter portion corresponding to white, a transparent filter portion may be provided, or no filter portion may be provided. The counter electrodes are made of a transparent conductive material, for example, ITO, etc., at positions corresponding to the pixel electrodes 16.

These color filter layer and counter electrodes may be disposed on the array substrate 30 side depending on the mode of the liquid crystal panel.

In FIG. 1, by outputting a signal to the scanning line 13 from a drive circuit that drives the liquid crystal panel, the signal is input into the gate electrode of the thin film transistor 17 electrically connected to the scanning line 13, and by outputting a signal from the drive circuit to the signal line 14, the signal is input into the source electrode of the thin film transistor 17 electrically connected to the signal line 14, and this thin film transistor 17 is controlled to perform switching, a pixel signal is written on the pixel electrode from the drain electrode of the thin film transistor 17, and the respective sub-pixels 15 are driven independently.

As a driving method for the sub-pixels 15 by using the drive circuit, a column inversion method capable of reducing power consumption is used. In the column inversion method, by respectively applying signals of negative polarity and positive polarity one by one alternately to the respective signal lines 14 from the drive circuit, the respective sub-pixels 15 are driven according to the signals of polarities input into the respective signal lines 14.

Here, a cause of occurrence of crosstalk according to the influence from the pixel array is described with reference to FIG. 5 to FIG. 7.

Figure 5:
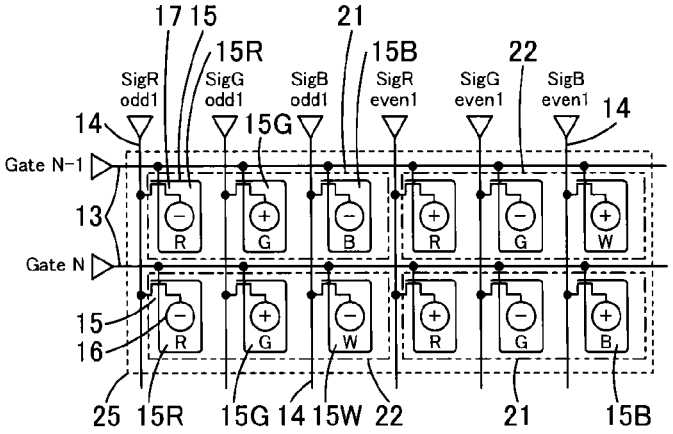
FIG. 5 is a front view schematically showing a comparative example of a display element.
Figure 6:
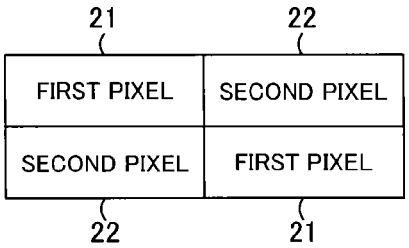
FIG. 6 is a block diagram of the comparative example of the display element.

As shown in FIG. 5 and FIG. 6, it is assumed that the pixel array of one period consists of four pixels so that the first pixel 21 and the second pixel 22 are juxtaposed to each other in the horizontal direction and the first pixel 21 and the second pixel 22 are arrayed alternately in the vertical direction.

Figure 7:
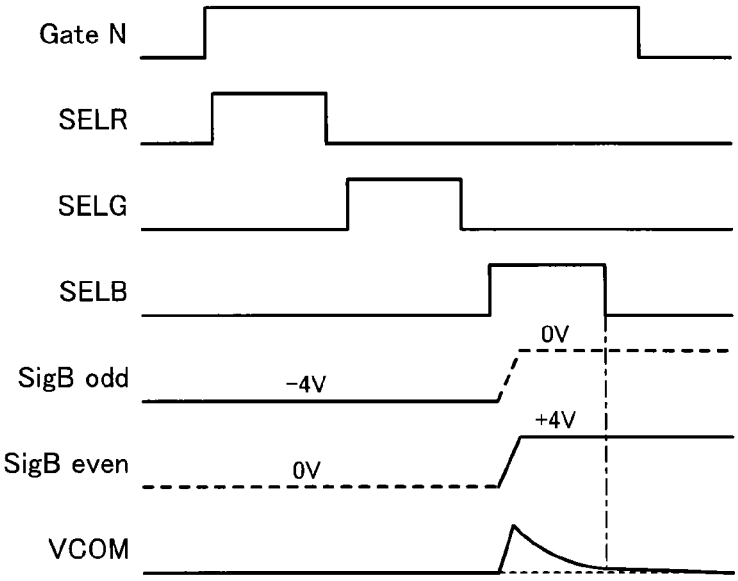
FIG. 7 is a waveform chart showing signals of the comparative example of the display element.

As shown in FIG. 7, in a state where a signal is applied to, for example, the N-th row (Gate N) of the scanning lines 13 by the drive circuit, the selectors (SELR, SELG, and SELB) of the respective colors of the drive circuit are turned on to apply signals to the signal lines 14, and accordingly, the sub-pixels 15 of the respective colors are driven.

In the pixel array as shown in FIG. 5 and FIG. 6, in the case where a blue window is displayed in the display region of the display element 10, in the N−1th row of the scanning lines 13, with reference to FIG. 7, for example, by applying a signal to change the potential from 0 V being a black potential (GND potential) to the negative polarity of −4 V to the SigB odd column of the signal lines 14, the blue sub-pixel 15B connected to the SigB odd column of the signal lines 14 is driven to display blue.

As shown in FIG. 7, to shift scanning from the N−1th row to the N-th row of the scanning lines 13, by applying a signal to change the potential of the SigB odd column of the signal lines 14 from the negative polarity of −4 V to 0 V being a black potential (GND potential) and change the potential of the SigB even column of the signal lines 14 from the black potential (GND potential) to the positive polarity of +4 V, the white sub-pixel 15W connected to the SigB odd column of the signal lines 14 displays black, and the blue sub-pixel 15B connected to the SigB even column of the signal lines 14 is driven to display blue.

When scanning is shifted from the N−1th row to the N-th row of the scanning lines 13, both the SigB odd column and the SigB even column of the signal lines 14 change in the same direction in which the potentials increase. As shown in FIG. 4, the common electrode 25 forms a parasitic capacitance C between the common electrode 25 and the signal lines 14 via the organic insulating film 35, so that if a bias occurs in the potential changes of the signal lines 14, the potential of the common electrode 25 also changes. As shown in FIG. 7, if the potential (VCOM) of the common electrode 25 changes and the potential change does not disappear before the selector (SELB) is turned off, due to this potential change, in response to turning-off of the selector, power supply is canceled, and the signal lines 14 that turned into a floating state are influenced by the potential change and cause horizontal crosstalk. FIG. 4 shows a pixel example in the FFS mode, and the same problem also occurs in the VA mode and the TN mode.

Figure 3:
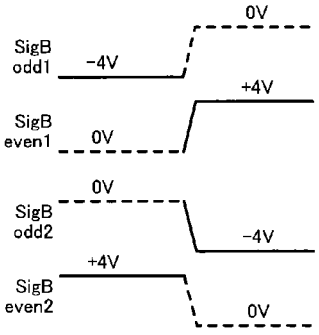
FIG. 3 is a waveform chart of signals of the display element.

On the other hand, in the present embodiment, the pixel array is constituted as shown in FIG. 1 and FIG. 2, so that when a blue window is displayed in the display region of the display element 10, in the N−1th row of the scanning lines 13, referring to FIG. 3, for example, a signal to change the potential from 0 V being the black potential (GND potential) to the negative polarity of −4 V is applied to the SigB odd1 column of the signal lines 14, and a signal to change the potential from 0 V being the black potential (GND potential) to the positive polarity of +4 V is applied to the SigB even2 column of the signal lines 14, and accordingly, the blue sub-pixels 15B and 15B connected to the SigB odd1 column and the SigB even2 column of the signal lines 14 are driven to display blue.

As shown in FIG. 3, to shift scanning from the N−1th row to the N-th row of the scanning lines 13, by changing the potential of the SigB odd1 column of the signal lines 14 from the negative polarity of −4 V to 0 V being the black potential (GND potential), and changing the potential of the SigB even2 column of the signal lines 14 from the positive polarity of +4 V to 0 V being the black potential (GND potential), the white sub-pixels 15W and 15W connected to the SigB odd1 column and the SigB even2 column of the signal lines 14 display black. Further, by applying a signal to the SigB even1 column of the signal lines 14 to change the potential from 0 V being the black potential (GND potential) to the positive polarity of +4 V, and applying a signal to the SigB odd2 column of the signal lines 14 to change the potential from 0 V being the black potential to the negative polarity of −4 V, the blue sub-pixels 15B and 15B connected to the SigB odd1 column and the SigB odd2 column of the signal lines 14 are driven to display blue.

To shift scanning from the N−1th row to the N-th row of the scanning lines 13, the SigB odd1 column and the SigB even1 column of the signal lines 14 change in the same direction in which the potentials increase, however, the SigB odd2 column and the SigB even2 column of the signal lines 14 change in the same direction in which the potentials lower, so that the potential changes of the common electrode 25 are canceled out in one period, the potential of the common electrode 25 becomes stable, and horizontal crosstalk is prevented from occurring.

Thus, with the display element 10 of the present embodiment, even in the case where the first pixels 21 each having sub-pixels 15 of three primary colors and the second pixels 22 each having sub-pixels 15 of two colors of the three primary colors and a sub-pixel 15 of a color other than the three primary colors are arrayed, along the horizontal direction, two each of the first pixels 21 and the second pixels 22 are provided, and at least either two of the first pixels 21 and the second pixels 22 are arrayed so as to be juxtaposed to each other, and along the vertical direction, the first pixel 21 and the second pixel 22 are arrayed alternately, so that horizontal crosstalk can be prevented from occurring.

Further, the first array group 23*a* including the first pixel 21, the second pixel 22, the second pixel 22, and the first pixel 21 that are arrayed in order along the horizontal direction, and the second array group 23*b* including the second pixel 22, the first pixel 21, the first pixel 21, and the second pixel 22 that are arrayed in order along the horizontal direction, are provided, and along the vertical direction, the first array group 23*a* and the second array group 23*b* are arrayed alternately, and accordingly, horizontal crosstalk can be prevented from occurring.

It is also possible that, the pixel array includes a first array group 23*a* including the first pixel 21, the first pixel 21, the second pixel 22, and the second pixel 22 that are arrayed in order along the horizontal direction, and a second array group 23*b* including the second pixel 22, the second pixel 22, the first pixel 21, and the first pixel 21 that are arrayed in order along the horizontal direction, and the first array group 23*a* and the second array group 23*b* are arrayed alternately along the vertical direction, and in this case, horizontal crosstalk can also be prevented from occurring.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A display device comprising:

a plurality of scanning lines including a first scanning line disposed along a first direction, and a second scanning line spaced apart from the first scanning line in a second direction intersecting the first direction and adjacent to the first scanning line;

a plurality of signal lines that are disposed along the second direction into which signals of different polarities are alternately input, respectively;

a first pixel which includes sub-pixels of three primary colors that are respectively disposed in the respective regions surrounded by the scanning lines and the signal lines so as to be juxtaposed to each other in the first direction;

a second pixel which includes sub-pixels of two colors of the three primary colors and a sub-pixel of a color other than the three primary colors; and a plurality of switching elements that are respectively connected to the scanning lines and the signal lines, and are switched by signals from the scanning lines and write signals corresponding to the signals from the signal lines on the sub-pixels when the switching elements are in an on state, wherein along the first direction, a first array group including the first pixel, the second pixel, the second pixel, and the first pixel that are arrayed to be juxtaposed to each other in that order in a row, and a second array group including the second pixel, the first pixel, the first pixel, and the second pixel that are arrayed to be juxtaposed to each other in that order in a row, are provided, the first array group is disposed between the first scanning line and the second scanning line, and the second array group is disposed in the second direction with the second scanning line sandwiched between the second array group and the first array group, the first pixel consists of a first sub-pixel, a second sub-pixel, and a third sub-pixel, the second pixel consists of the first sub-pixel, the second sub-pixel, and a fourth sub-pixel, and the first sub-pixel of the first pixel and the first sub-pixel of the second pixel are disposed in the second direction with the second scanning line sandwiched therebetween and disposed between two of the common signal lines.

2. The display device according to claim 1, wherein the second sub-pixel of the first pixel is disposed adjacent to the first sub-pixel of the first pixel, the second sub-pixel of the second pixel is disposed adjacent to the first sub-pixel of the second pixel, and the second sub-pixel of the first pixel and the second sub-pixel of the second pixel are disposed in the second direction with the second scanning line sandwiched therebetween and disposed between two of the common signal lines.

3. The display device according to claim 2, wherein the third sub-pixel of the first pixel is disposed adjacent to the second sub-pixel of the first pixel, the fourth sub-pixel of the second pixel is disposed adjacent to the second sub-pixel of the second pixel, and the third sub-pixel of the first pixel and the fourth sub-pixel of the second pixel are disposed in the second direction with the second scanning line sandwiched therebetween and disposed between two of the common signal lines.

4. The display device according to claim 3, wherein the first sub-pixel displays red, the second sub-pixel displays green, the third sub-pixel displays blue, and the fourth sub-pixel displays white.

* * * * *